US008528239B2

(12) United States Patent
Andrina

(10) Patent No.: US 8,528,239 B2
(45) Date of Patent: Sep. 10, 2013

(54) QUICK COUPLING DEVICE FOR CONNECTING A TOOL TO A HANDLING EQUIPMENT, SUCH AS THE ARM OF AN EXCAVATOR

(76) Inventor: Giovanni Andrina, Bosconero (IT)

( * ) Notice: Subject to any disclaimer, the term of this patent is extended or adjusted under 35 U.S.C. 154(b) by 369 days.

(21) Appl. No.: 13/087,223

(22) Filed: Apr. 14, 2011

(65) Prior Publication Data

US 2011/0252673 A1 Oct. 20, 2011

(30) Foreign Application Priority Data

Apr. 16, 2010 (IT) ..... TO2010A0312

(51) Int. Cl.
*E02F 3/96* (2006.01)

(52) U.S. Cl.
USPC ..... 37/468; 414/723

(58) Field of Classification Search
USPC ..... 37/231, 403–409, 468; 172/272, 172/273; 414/722–724, 686; 403/150, 151, 403/157, 159, 361, 321, 324, 116, 335–338
See application file for complete search history.

(56) References Cited

U.S. PATENT DOCUMENTS

| | | | | |
|---|---|---|---|---|
| 7,735,249 | B2 * | 6/2010 | Muller | 37/468 |
| 7,779,562 | B1 * | 8/2010 | Loveless et al. | 37/231 |
| 7,832,130 | B2 * | 11/2010 | Sederberg et al. | 37/468 |
| 7,866,935 | B1 * | 1/2011 | Wilt et al. | 414/723 |
| 8,419,339 | B2 * | 4/2013 | Okumura et al. | 414/723 |

FOREIGN PATENT DOCUMENTS

| | | |
|---|---|---|
| EP | 1353011 | 10/2003 |
| GB | 2330568 | 4/1999 |

* cited by examiner

*Primary Examiner* — Robert Pezzuto
(74) *Attorney, Agent, or Firm* — Hayes Soloway P.C.

(57) ABSTRACT

A quick coupling device adapted to connect a tool to the arm of a handling equipment comprises a first support member that can be connected to an end of the arm, and a second support member that can be fixed to the tool, which members are mutually engageable as a result of a relative movement along an axis of coupling transverse to the end of arm. Each support member comprise two opposed coupling formations having a double inclination, so as to turn out to be convergent towards the axis of coupling both in the direction of mutual connection of the support members and with respect to a plane transverse to the axis of coupling. A support member includes at least one movable holding member adapted to be inserted in at least one corresponding seat of the other support member in the mutually coupled configuration, in order to mutually lock the two support members.

15 Claims, 7 Drawing Sheets

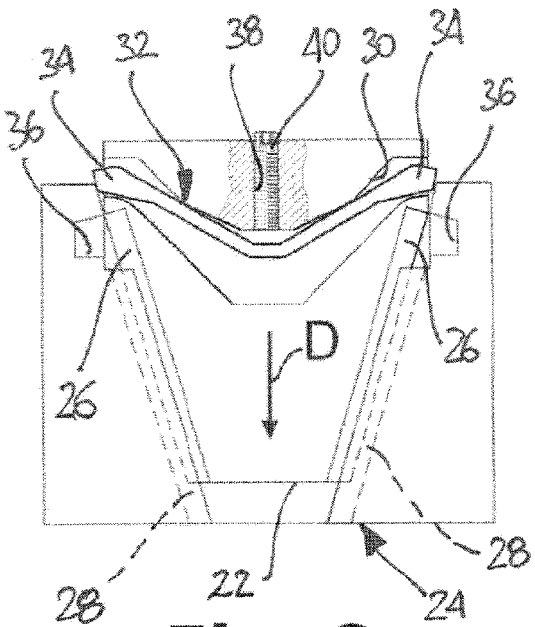
Fig. 6
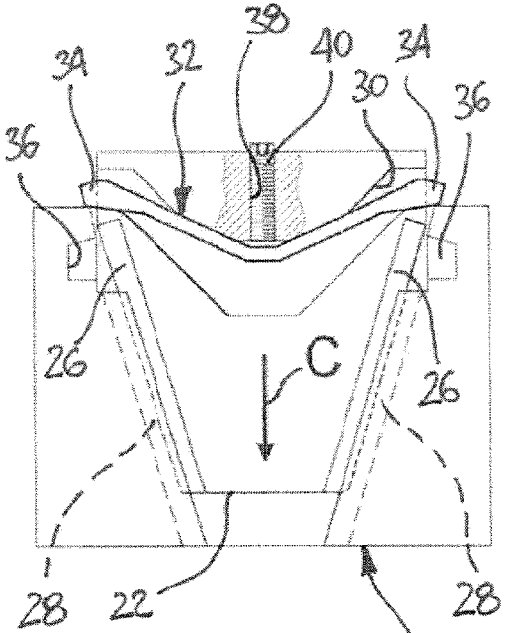
Fig. 7
Fig. 8

QUICK COUPLING DEVICE FOR CONNECTING A TOOL TO A HANDLING EQUIPMENT, SUCH AS THE ARM OF AN EXCAVATOR

BACKGROUND OF THE INVENTION

The present invention refers in general to equipments the be used for excavation, demolition or earthwork operations, and relates in particular to a quick coupling device for connecting a tool to a handling equipment, such as the articulated arm of an excavator, or similar.

Known devices that allow tools, such as buckets, cutters and demolisher hammers, to be quick coupled to the articulated arm of an excavator in different working phases during execution, earthwork or demolition operations, allow the time to substitute the tools to be reduced. In the most common case, these devices comprise a first support member connected to the free end of the articulated arm and a second support member connected to the tool, which support members can be mutually connected by mechanical coupling members that comprise a pair of generally parallel pins interposed between the aforesaid support members.

Some known quick coupling devices, such as for example that one described in GB-A-2 330 568, comprise movable hook members associated with the first support member, and therefore with the end of the handling arm, which are rotatably mounted in order to allow the aforesaid pins connected to the second support member to be grasped or released, rotation of the hook members being controlled by a hydraulic or mechanical control system.

Although these known devices allow the tools to be connected to an articulated handling arm to be replaced quickly, they have the drawback that they acquire clearances in the use, as a result of the wear the mechanical members of the coupling device are subjected to, because of the severe stresses the tools and the handling arm undergo in the use. These clearances cause the stability of the connection to be degraded in the time, and originate annoying vibrations that can cause a progressive damaging of the tools and of the handling arm up to jeopardize their correct operation.

Moreover, these known devices have relevant sizes in the axial direction of the handling arm and are remarkably cumbersome, which reduces their versatility of use and might negatively modify geometry and possibility of movement of the tools.

In particular, the invention relates to a quick coupling device for connecting a tool to a handling equipment, such as the arm of an excavator, comprising a first support member adapted to be connected to an end of said arm, and a second support member adapted to be fastened to the tool to be connected to said arm, wherein said support members are mutually engageable as a result of a relative movement along an axis of coupling generally transverse to the end of said arm, each support member comprising two opposed coupling formations having a double inclination so as to converge towards the axis of coupling both along the direction of mutual connection of the support members and with respect to a plane transverse to the axis of coupling, one of the support members including movable holding means which are adapted to engage at least a corresponding seat of the other support member in the mutually coupled configuration of the support members in order to cause mutual locking of the two support members.

EP-A-1 353 011 discloses a coupling device of the type defined above, which is adapted to allow a working tool to be removably connected to a working machine. The device comprises a first support member in the form of a trapezoidal plate, connected to the machine, and a second support member, having a seat which shape correspond to said plate, connected to the tool. The side edges of the first support member, which are tapered with respect to the axis of coupling in the second portion and the cross-sectional of which is V shaped, are intended to engage side guide formations the shape of which corresponds to that of a second support member. Owing to the shape of the side edges of the plate and the seat, which allow the first and a second support member to be kept in predetermined mutual positions, the plate of the first support member cannot be pushed against the counter surface of the seat. Moreover, the second support member, at the narrow end of the trapezoidal seat, is provided with an abutment crosspiece that constitutes an end-of-stroke member, and that limitates therefore the introduction of the first member in the respective seat. In this manner, the plate of the first member can be inserted into the seat of the second member only until it interferes with such a crosspiece, which prevents the possibility of recovering clearances between the two support members. Because of the structure of the device of this document, therefore, clearances between the side edges of the first support member and the respective guide formations of the second member may originate, that can not be easily recovered and that, in the use, may cause vibrations to arise.

SUMMARY OF THE INVENTION

In order to overcome such drawbacks, the subject of the invention is a quick coupling device of the type defined in the appended claims.

In particular, in the device according to the invention, the second support member lacks in any end-of-stroke member for stopping the relative movement of the support members along the axis of coupling, and both the opposite coupling formations of the second support member have respective guide surfaces facing a base portion of the second support member in order to define, together with said base portion, respective undercut side seats for the engagement of the opposite coupling formations of the first support member so that, as a result of the relative movement of the support members along the axis of coupling and owing to the mutual engagement of said opposite coupling formations, the first support member wedge into the second support member so that a force of connection is generated, that is applied to the support members and is directed perpendicular to the axis of coupling, which causes the connection between them to be forced proportionally to the force of insertion of the first support member into the second support member.

By virtue of this idea of solution, the device of the invention allows the tools to be connected to the handling arm, to be replaced in a simple and safe manner, and at the same time their mutual connection to be made particularly firm and effective in addition to avoid any possibility of accidental uncoupling. Moreover, by virtue of the structure of the quick coupling device of the invention, its size is particularly compact in the axial direction of the handling arm, to full advantage of the versatility of use and of the possibility of movement of the tools connected by it to the arm.

According to a preferred feature of the invention, said holding means are resiliently urged so as to snap engage at least a respective seat formed in the second support member.

In this manner, the holding means allow a further safety of the coupling to be assured for the quick coupling device.

According to another preferred feature of the invention, the holding means allow that possible clearances are automatically recovered, which are originated between the support members in the direction of the axis of coupling.

In this manner, the device of the invention turns out to be particularly effective in the use since it is not affected by possible mechanical clearances that could originate in the use between its members as a result of the high stresses the tools and the handling arm are subjected to, which allows arising of vibrations to be considerably reduced.

Further characteristics and advantages of the invention will ensue more clearly from the following detailed description, supplied as a non limitative example and referred to the appended drawings that show two exemplifying embodiments of the invention, and in which:

DETAILED DESCRIPTION OF THE INVENTION

Figure 1:
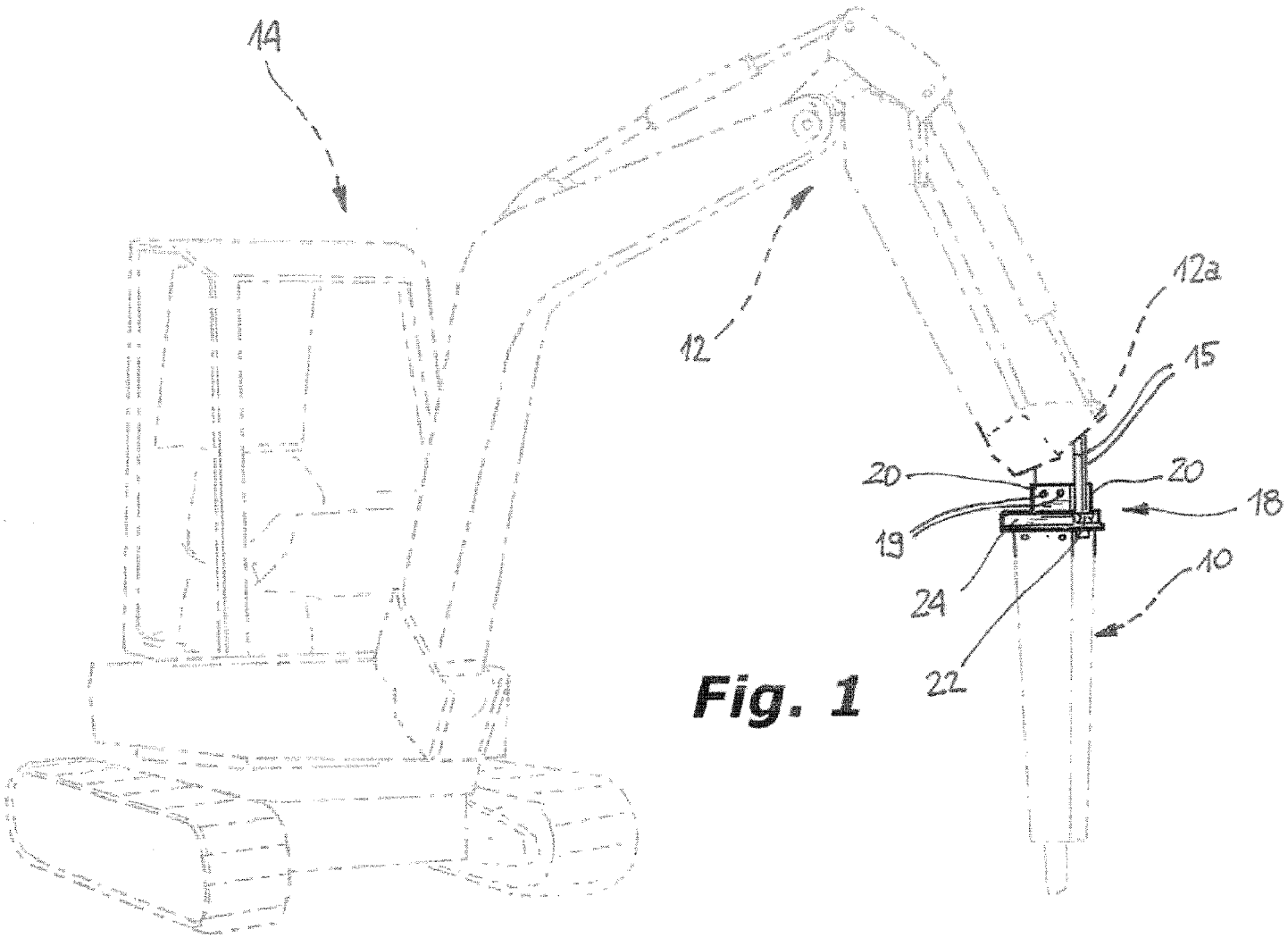
FIG. 1 is a schematic perspective view of an excavator provided with an arm for handling a tool.
Figure 2:
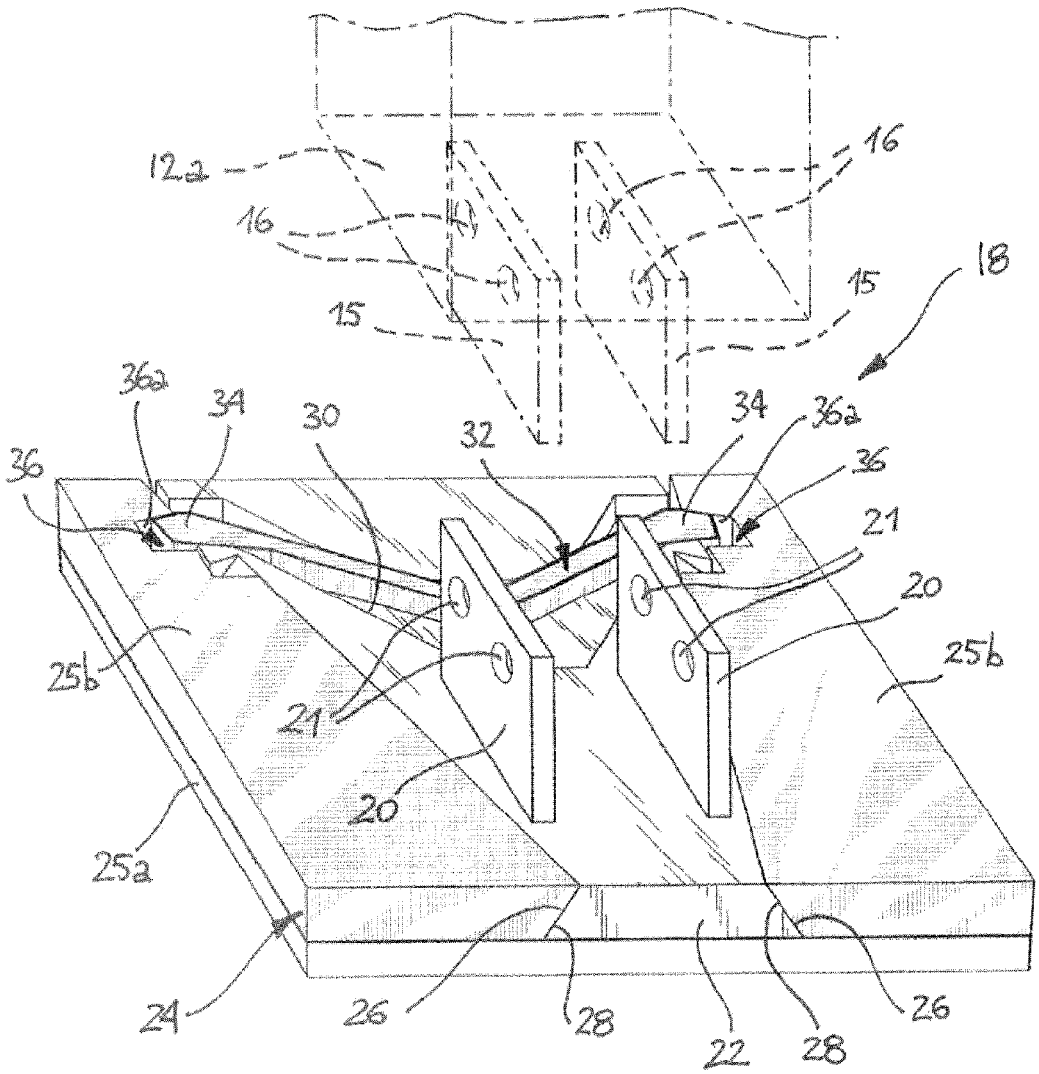
FIG. 2 is a schematic perspective view of a quick coupling device according to a first embodiment of the invention, adapted to connect a tool to the handling arm.
Figure 3:
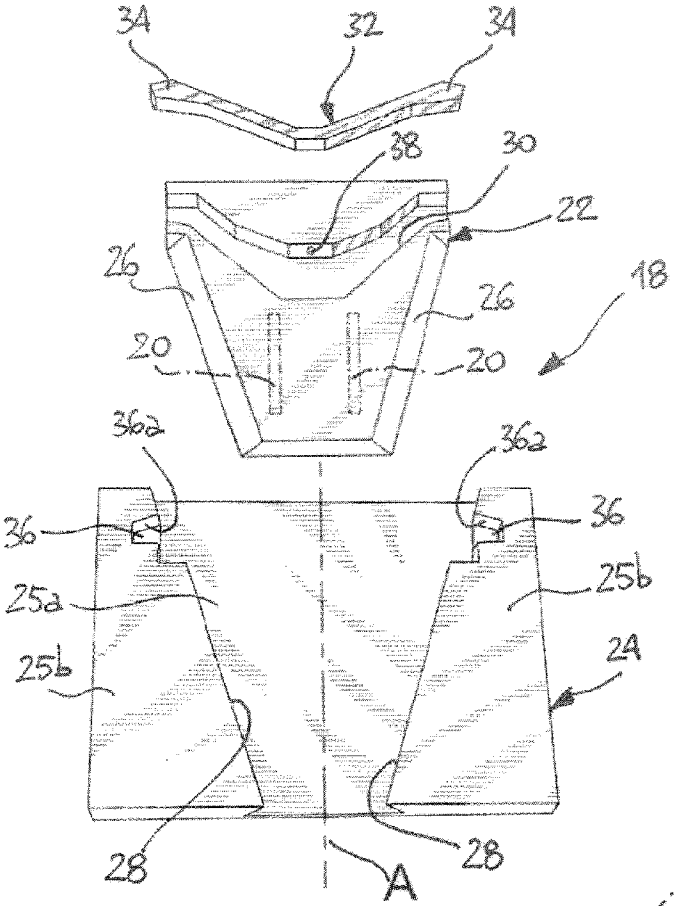
FIG. 3 is a perspective exploded view of the main elements of the device of FIG. 2.
Figure 4:
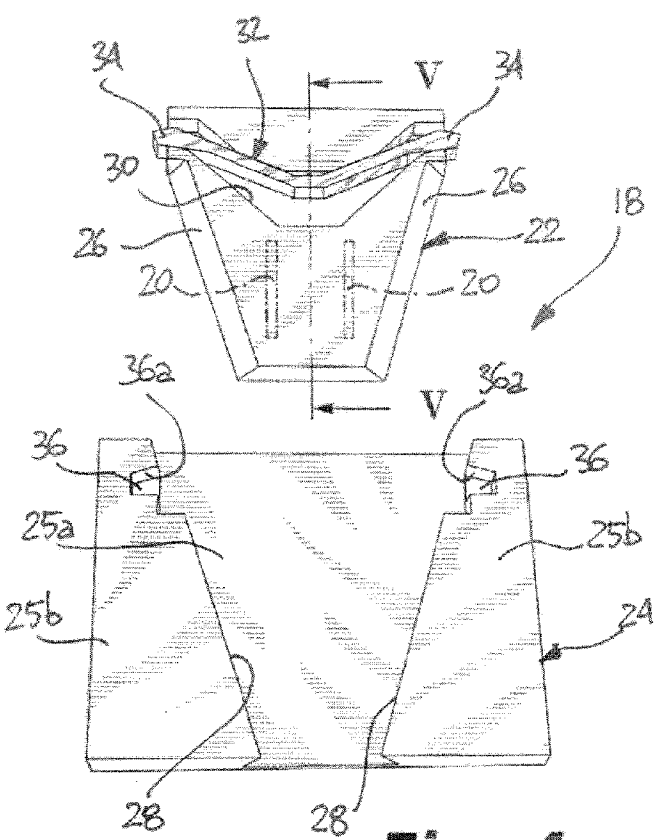
FIG. 4 is a perspective view of the elements of FIG. 3 in their condition before the mutual connection.
Figure 5:
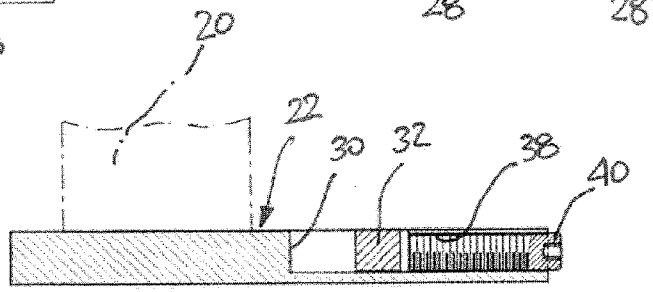
FIG. 5 is a side elevational view sectioned along line V-V of FIG. 4, FIGS. 6 to 9 are top elevational views similar to each other showing as a sequence the coupling steps of the coupling device according to the first embodiment of the invention.
Figure 11:
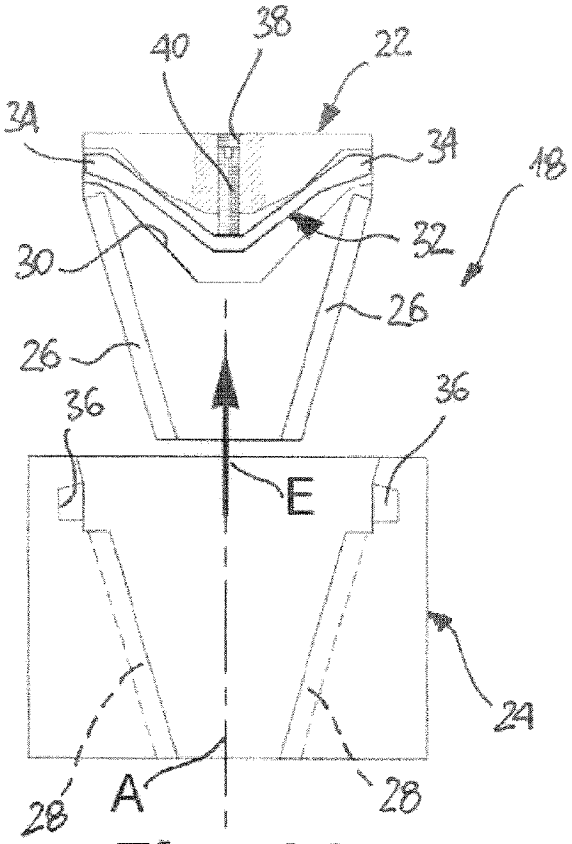
FIGS. 10 and 11 are views similar to FIGS. 6 to 9 showing the uncoupling steps of the coupling device of the first embodiment of the invention.
Figure 10:
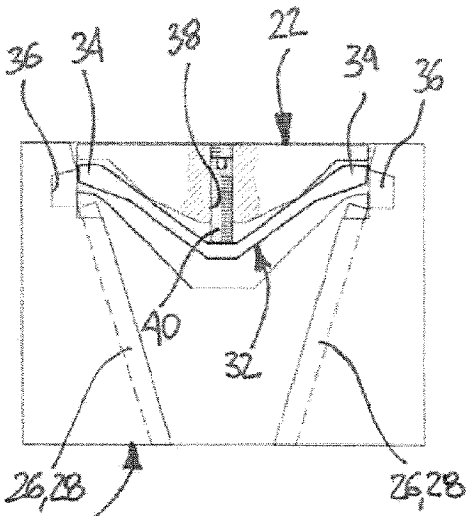

With initial reference to FIG. 1, a working tool 10, for example a demolishing hammer, is connected through a quick coupling device indicated 18 in its whole, to the free end 12*a* of an articulated arm 12 of an excavator 14, in order to allow demolition works to be performed. Of course, the tool 10 to be connected to the arm 12 by the device 18 can be of a any known type, such as a bucket or a cutter, in the case in which it is required to perform earthwork or digging works by the excavator 14.

With reference to FIGS. 2 to 11, which show a first embodiment of the invention, in the most common case, two parallel brackets 15 extend from the end 12*a* of the arm 12 according to a fork configuration, in which respective pairs of holes 16 are formed in order to allow insertion of two transverse pins 19 (FIG. 1). The pins 19 engage also holes 21 formed in another pair of parallel brackets 20 extending according to a fork configuration from a first support member 22 of the device 18.

The device 18 comprises also a second support member 24 intended to be fixed to an end face of the tool 10, for example, in the case of a demolishing hammer, to an end of its elongated body opposite to that one from which a working tip extends. The members 22 and 24 are intended to be mutually engaged as a result of a relative movement, typically a movement of the first member 22 with respect to the second member 24, along an axis of coupling indicated by A, which extends along a direction generally transverse to the end 12*a* of arm 12.

Usually, the member 22 consists of a flat plate, but it might have an arched shape also. It has a substantially isosceles trapezoidal shape in plan, that is conveniently symmetrical with respect to the axis A. Both the two opposite inclined edges of the member 22 extend according to directions that converge towards the axis A. Each of such inclined edges has a coupling surface 26 inclined with respect to the general plane of the member 22, in such a manner that the two opposite surfaces 26 converge also with respect to planes transverse to the axis A.

The member 24 has an upper seat substantially shaped as an isosceles trapezoid which shape corresponds to that of the member 22, which seat is limited sideways by a pair of opposite, preferably symmetrical, inclined edges converging towards the axis A. Such edges have respective coupling surfaces 28 inclined with respect to the general plane of the member 24, so that the opposite surfaces 28 converge also with respect to planes transverse to the axis A.

In the most general case, the coupling surfaces 26 and can be rectilinear or arched or curvilinear, correspondingly to each other, so as to constitute a double wedge coupling system which allow a remarkable solidity of coupling to be achieved.

The member 24, which is also conveniently made with the shape of a flat, or possibly arched, plate so as to correspond to the member 22, may consist of a single piece, or comprise a base plate 25*a* to which a pair of side auxiliary plates 25*b* are fixed on its upper face, each of which forms a respective edge provided with a respective surface 28.

The pairs of surfaces 26 and 28 of the member 22 and of the member 24, which have a double inclination, constitute mutual engagement formations of the device 18, adapted to attain a wedging according to two perpendicular directions, which allows an extremely solid and effective locking to be achieved.

Holding means are associated with the device 18 in order to firmly hold the elements 22 and 24 in the mutual engagement condition. In particular, the member 22 has a substantially arched cavity 30 formed in its thickness, that preferably opens towards the arm 12, in which a usually preloaded leaf spring 32 is inserted, in such a manner that the opposite ends 34 of the spring 32, in the usual condition, project from opposite sides of the member 22 close to an end of its inclined edges 26.

The member 24 has respective seats 36, close to one of the ends of its inclined edges 28, intended to receive the ends 34 of the spring 32 in the mutually coupled configuration of the members 22 and 24, in order to lock them mutually.

Preferably, the ends 34 of the spring 32 are tapered in such a manner that, as a result of insertion of the member 22 in the seat of the member 24, the ends 34 are snap engaged in the seats 36 of the member 24.

Moreover, the seats 36 have an entry portion 36*a* at their side opposite to the edges 28, which is conveniently inclined with respect to the axis A, so that engagement of the tapered ends 34 of the spring 32 in such slanted entry portions 36*a* causes a thrust to be applied to the member 22 towards the member 24 along the direction of the axis A, in order to allow possible clearances that might be originated in the direction of the axis A between the support members 22 and 24 as a result of the use of the device 18, to be recovered automatically.

Also other types of holding means, for example made by a pair of preloaded spring pins or cam members and resiliently biased towards an extended configuration that project from one or more sides of the member 22 can be used, which are intended to snap engage one or more respective seats 36 of the member 24.

Conveniently, disengaging means for disengaging the ends 34 of the spring 32 from the seats 36 of the member 24, are associated with the member 22, which can be operated when it is necessary to separate the tool 10 from the arm 12. These disengaging means can be remotely controlled, for example by the operator of the excavator 14, in which case they comprise an actuator (not shown in the figures), particularly hydraulically or electrically controlled, which is associated with the first member 22 and is adapted to control retraction of the ends 34 of the spring 32, for example by increasing its bending in the seat 30, in order to extract such ends from the seats 36 of the second member 24, so that the members 22 and 24 can be separated as a result of their relative movement along the axis A.

As an alternative to the solution of remote control, and according to a simpler measure that can be used with quick coupling devices 18 adapted for tools 10 having a lower weight, the disengaging means can be of the mechanical type adapted to be manually driven. According to what shown in the figures as an example, a screw 40 can be associated with the first member 22, which engages a through threaded axial hole 38 opening in the cavity 30. By screwing the screw 40 in the hole 38, its end facing the spring 32 moves until it interferes with the central portion of the spring 32 and pushes it in order to increase its bending so as to cause the ends 34 to be retracted with respect to the sides of the member 22.

As an alternative, other disengaging means of the mechanical type or remotely controlled by different kinds of actuators can be used in order to cause the ends of the spring 32 or of other appendages protruding from the member 22 to be retracted, so as to unlock the member 22 with respect to the member 24, when such members need to be separated starting from their mutually engaged condition.

The operation of the quick coupling device 18 of the first embodiment is schematically shown in FIGS. 6 to 11.

Figure 9:
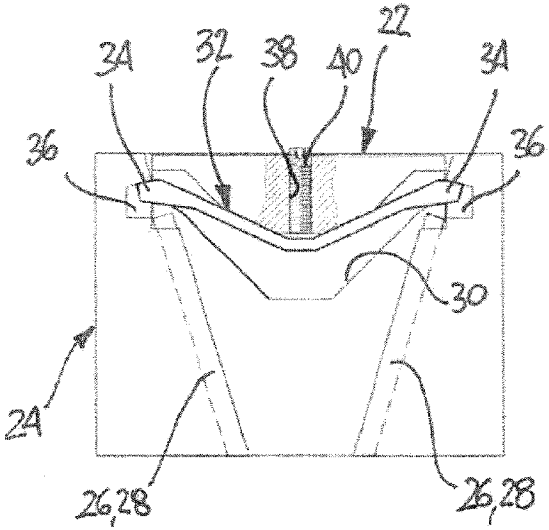
Figure 12:
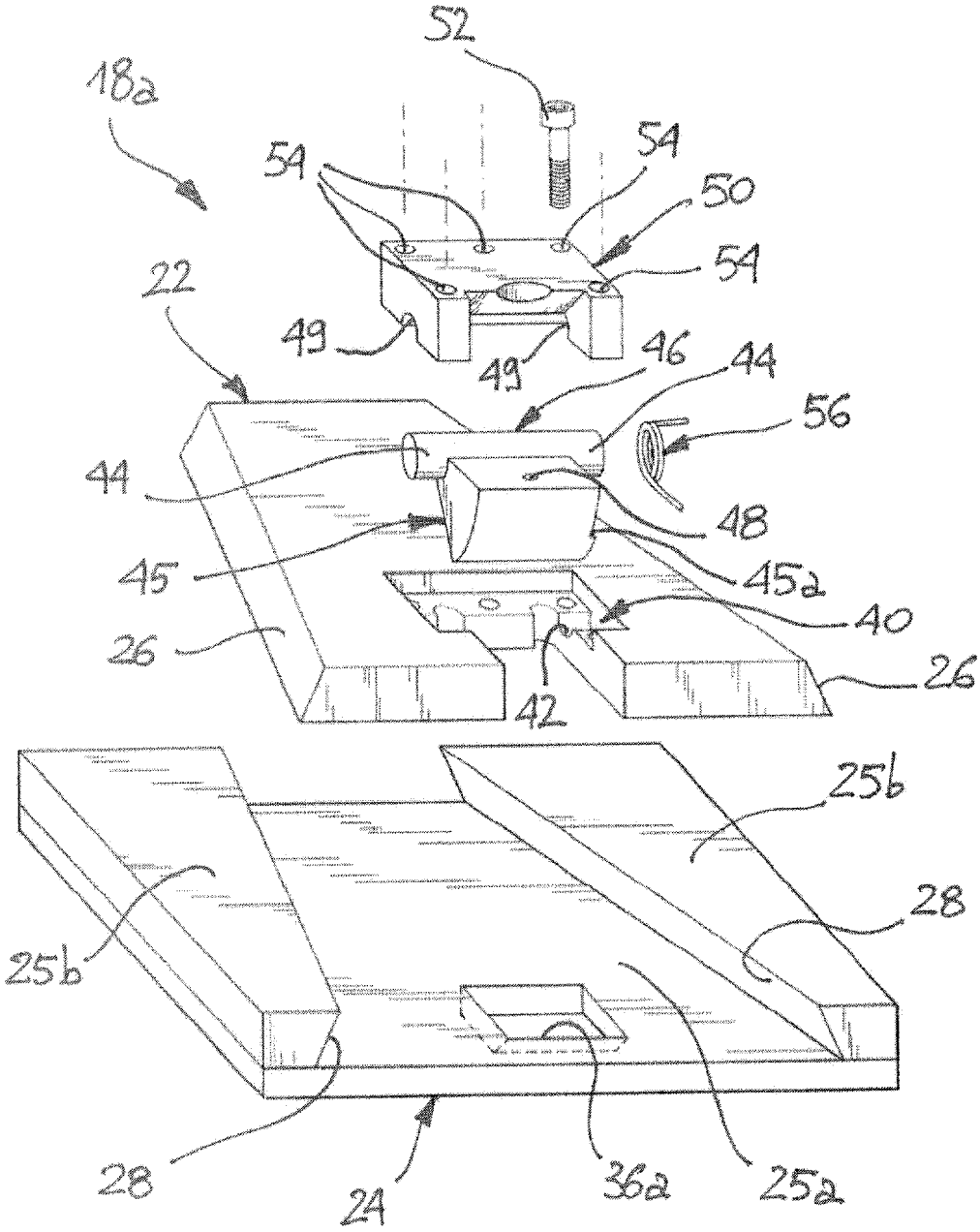
FIG. 12 is a schematic perspective and exploded view of the main components of a second embodiment of the coupling device of the invention.

During the coupling step of the device 18 (FIGS. 6 to 9), the member 22 is aligned with respect to the member 24, along the direction of the axis A. As a result of the linear approach of the member 22 with respect to the member 24 (arrow B of FIG. 6), the lower face of the member 22 is brought into contact with the upper face of the seat formed in the member 24, and slides until the inclined edges 26 and 28 are brought into mutual contact. The relative movement of the elements 22 and 24 goes on until the ends 34 of the spring 32 interfere with the front edge of the member 24 (FIG. 7). A further movement of the member 22 along the direction of the axis A (arrows C and D of FIGS. 7 and 8), by virtue of the tapered shape of the ends 34 and of their interference with the front surface of the member 24, cause the spring 32 to be contracted and its ends 34 to undergo a corresponding retraction until the latter snap engage the seats 36 of the member 24 (FIG. 9). In this configuration, by virtue of the tapered shape of the ends 34 and of the inclination of the entry portion 36*a* of the seats 36, a resilient force is originated between the ends 34 and the portions 36*a* of the seats 36, which force tends to compress the member 22 towards the member 24 along the direction of the axis A, so as to allow possible clearances originated between the two members 22 and 24 in the use, to be automatically and resiliently recovered.

In order to disengage the quick coupling device 18 when the tool 10 has to be separated from the arm 12 (FIGS. 10 and 11), with reference to the mechanical solution of the disengagement means described above and shown in the figures, the screw 40 is screwed in the hole 38 so that one end of it projects into the cavity 30 in which the spring 32 is arranged, until the end of the screw 40 interferes with the central portion of the spring 42. By screwing some more the screw 40, it causes bending of the spring 32 to be increased and, as a consequence, its ends 34 to be retracted until the seats 36 are released, in such a manner that the member 22 can be extracted from the seat of the member 24 by a rectilinear relative movement along the axis A (arrow E of FIG. 11).

A second embodiment of the invention will be now described with reference to FIGS. 12 to 15, in which elements equal or similar to those of the first embodiment have been indicated by the same numeral references. In particular, the elements already described with reference to the first embodiment will not be described again.

In this case, the holding means associated with the quick coupling device of the invention, here indicated 18*a* in its whole, comprise a cavity 36*a* formed in a central zone of the base plate 25*a*, which cavity has a surface inclined towards the entry zone of the plate 22 in the seat of the member 24, so that the cavity 36*a* has a wider section facing the plate 22.

The trapezoidal plate 22, in its turn, has a shaped central zone 40, closer to its wider edge perpendicular to the axis A. In the upper portion of the seat 40, at parts sidewise opposite to the longitudinal axis of coupling A, two semi-cylindrical seats 42 are formed for the engagement of opposite ends 44 of a shaft 46 perpendicular to the axis A. An eccentric member 45 is fixed to the shaft 46, which projects radially from it towards the wider transverse side of the trapezoidal member 22.

A transverse section of the member 45 has the shape of a substantially circular sector with a center angle of about 50°-60°, limited on its upper and lower part by a pair of almost radial surfaces between which a smooth outer radial surface extends, opposite to the shaft 46, the distance of which from the shaft 46, namely its radius with respect to the axis of such a shaft, slightly increases between the lower radial surface and the upper surface of the member 45. The radially outer surface of the member 45 is intended to cooperate with the inclined surface of the cavity 36*a*, the inclination of which promotes sliding on it of such a radially outer surface.

The seat 40 is closed on the top by a cover 50 fixed to the member 22 by screws 52 crossing through holes 54 formed in the cover 50, which are screwed in corresponding threaded holes of the plate 22, that open in the seat 40. In particular, the cover 50 has on its lower surface a pair of half-cylindrical seats 49 arranged in positions corresponding to the seats 42 and defining, together with the seats 42, cylindrical seats for rotatably receiving the ends 44 of the shaft 46.

A return helical spring 56 surrounds one of the ends 44 of the shaft 46 and comprises two projecting end branches one of which rests against a projection 45*a* of the eccentric member 45, while the other rests against the cover 50, with the aim of applying a resilient thrust to the eccentric member 45 in order to urge it to the bottom, in a position in which it projects below the plate 22.

Moreover, an almost tangential hole 48 is formed on the upper surface of the member 45, which can be engaged by the tip of a tool (not shown) in order to allow the member 45 to be drawn into rotation against the resilient action of the spring 56.

Figure 13:
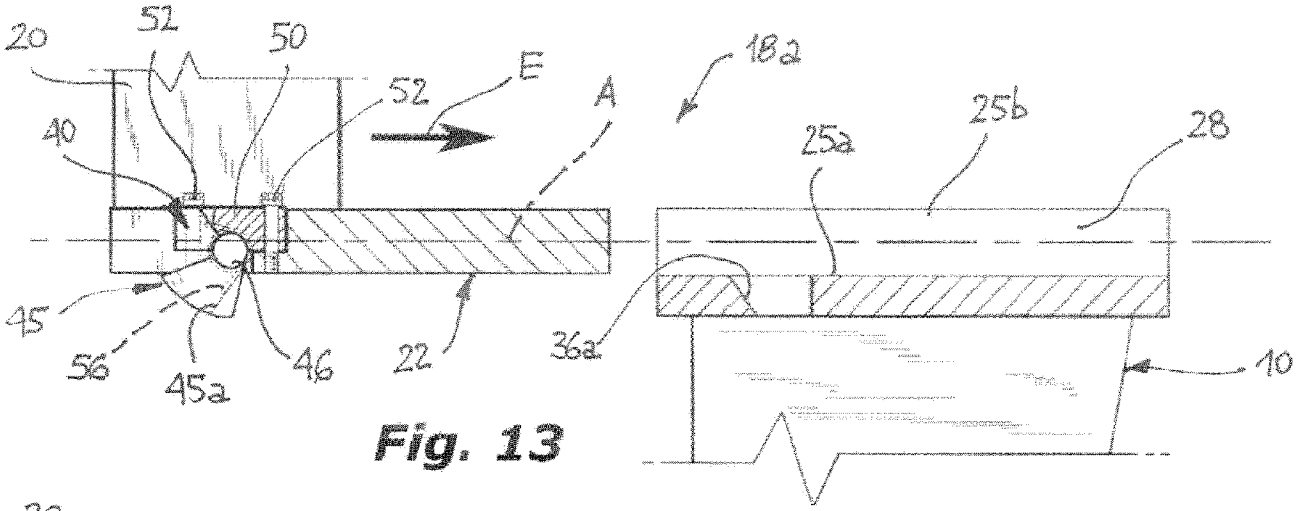
FIGS. 13 to 15 are side elevational and sectioned views showing as a sequence the coupling steps of the coupling device of the second embodiment of the invention.
Figure 15:
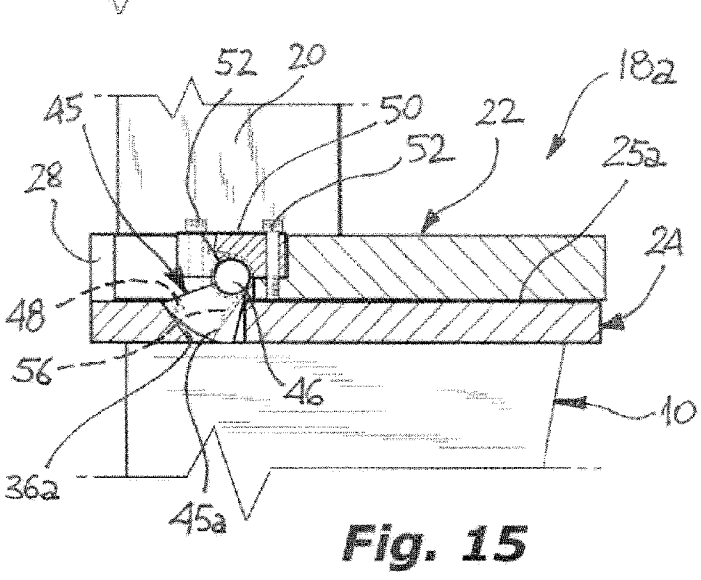
Figure 14:
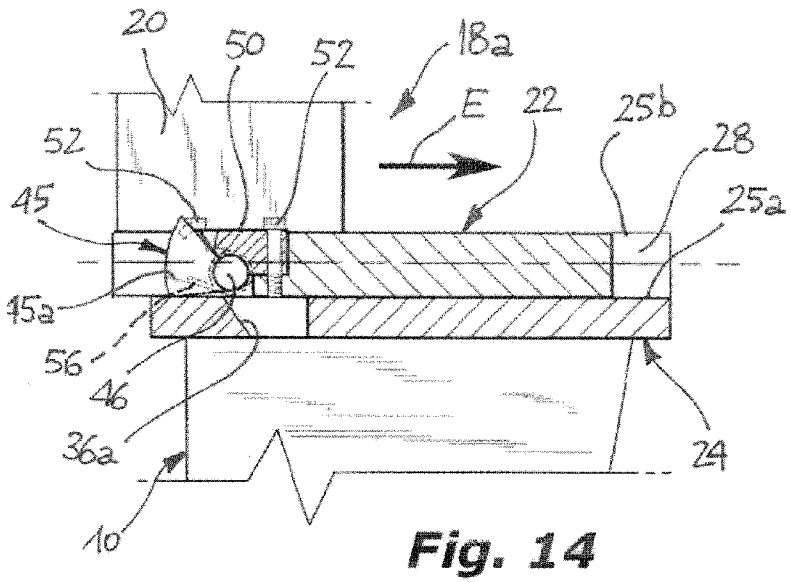

In operation of the device 18*a*, and with particular reference to FIGS. 13 to 15, coupling of the members 22 and 24 requires the member 22 to be aligned in the direction defined by the axis of coupling A of the member 24. As a result of a movement of the member 22 along the axis A in the direction indicated by arrows E of FIGS. 13 and 14, such as already described with reference to the first embodiment, the lower face of the member 22 is brought into contact with the upper face of the plate 25*a* that limits the seat formed in the member 24, and it slides until the pair of inclined edges 26 and 28 reach mutually facing positions.

Going on the relative movement of the members 22 and 24, the lower radial surface of the eccentric member 45 interferes with the front edge of the member 24 and therefore the member 45 rotates about the axis of the shaft 46 (in the clockwise direction, with reference to the figures), against the resilient action of the return spring 56, until a position is reached in which its lower surface substantially rests on the plate 25*a* (FIG. 14).

As a result of a further sliding of the member 22 with respect to the member 24 in the direction of arrow E, the eccentric member 45 reaches the cavity 36*a* and, when its lower edge reaches the upper edge of the inclined wall of the cavity 36*a*, owing to the stress caused by the spring 56, it snap engages such a cavity (FIG. 15). In this configuration, the inclined edges 26 and 28 reach the mutual contact condition and the opposed coupling formations 26 of the first support member 22 engage the undercut side seats defined between the base portion 25*a* and the opposed coupling formations 28 of the member 24, in such a manner that the first member 22 wedges into the second member 24. As a consequence, a coupling force is applied to the support members 22 and 24, which is directed perpendicular to the axis of coupling A and causes a forced coupling to be accomplished, the entity of which is proportional to the force of insertion of the first support member 22 into the second support member 24. Moreover, the radially outer surface of the member 45, by virtue of such an inclination, begins to slide on the inclined surface of the cavity 36*a*.

Since the radius of the radially outer surface of the member 45 increases from its lower radial surface to its upper radial surface, sliding of the member 45 on the inclined surface of the cavity 36*a*, as a result of the thrust of the spring 56 applied on the shaft 46, and therefore on the member 22, originates a thrust in the direction of the axis A, which causes a further forward movement of the member 22 with respect to the member 24. By virtue of the shape of the edges 26 and 28 and of this thrust applied to the member 22, the member 22 wedges into the member 24 and originates a forced coupling owing to the contact of the member 22 against the plate 25*a*. By virtue of this forced coupling, possible clearances existing between the members 22 and 24 in the direction perpendicular to the plate 25*a* are eliminated automatically, since the eccentric member 45, in the case in which such clearances should exist, penetrates more into the cavity 36*a* and therefore originates a greater thrust on the member 22 in the seat of the member 24, which wedges more the member 22 into the member 24.

In order to disengage the quick coupling device 18*a*, when separation of the tool 10 from the arm 12 is required, the eccentric member is rotated in such a manner that it disengages the cavity 36*a*, by means of a tool inserted in the hole 48 of the eccentric member 45, which is operated so as to overcome the resilient action of the spring 56, so as to allow the member 22 to be extracted from the seat of the member 24 along the axis A.

As an alternative, a remote control device for controlling the position of the eccentric member 45 can be provided, which includes an actuator (not shown in the figures), for example hydraulically or electrically controlled, for controlling the rotation of the member 45 against the resilient thrust action of the spring 56.

In both the embodiments described above, the second support member 24 do not comprise any end-of-stroke member for stopping the movement of the support member 22 with respect to the support member 24 along the axis of coupling A, so that the support member 22 can be inserted to the bottom of the seat of the member 24 until any relative clearance is eliminated, so as to assure always that an optimal forced coupling of the members 22 and 24 is achieved.

What is claimed is:

1. A quick coupling device for connecting a tool to a handling equipment, such as the arm of an excavator, comprising a first support member adapted to be connected to an end of said arm, and a second support member adapted to be fastened to the tool to be connected to said arm, wherein said support members are mutually engageable as a result of a relative movement along an axis of coupling generally transverse to the end of said arm, each support member comprising two opposed coupling formations having a double inclination so as to converge towards the axis of coupling both along the direction of mutual connection of the support members and with respect to a plane transverse to the axis of coupling, one of the support members including movable holding means which are adapted to engage at least a corresponding seat of the other member in the mutually coupled configuration of the support members in order to cause mutual locking of the two support members, wherein the second support member lacks of any end-of-stroke member for stopping the relative movement of the support members along the axis of coupling, and both the opposed coupling formations of the second support member have respective guide surfaces facing a base portion of the second support member in order to define, together with said base portion, respective side undercut seats for the engagement of the opposed coupling formations of the first support member, whereby, as a result of the relative movement of the support members along the axis of coupling and owing to the mutual engagement of said opposed coupling formations, the first support member wedges into the second support member and originates a coupling force applied to the support members and directed perpendicular to the axis of coupling, which causes a forced coupling of them that is proportional to the coupling force of the first support member into the second support member.

2. A device according to claim 1, wherein the two engagement formations of each support member converge symmetrically with respect to said axis of coupling.

3. A device according to claim 1, wherein each support member comprises a respective flat plate.

4. A device according to claims 1, wherein said holding means are resiliently biased so as to snap engage at least a respective seat formed in the second support member.

5. A device according to claim 4, wherein said holding means have a pair of end appendages made by respective sprung pins resiliently urged towards a configuration extended and projecting from opposite sides of the first support member, said appendages being intended to snap engage a pair of seats formed in a position close to an end of the respective coupling formations.

6. A device according to claim 5, wherein said end appendages consist of the opposite ends of a leaf spring arranged according to an arched configuration in a corresponding cavity of the first support member.

7. A device according to claim 6, wherein the end appendages of the holding means are tapered.

8. A device according to claim 7, wherein said seats of the second support member have an entry portion inclined with respect to said axis of coupling.

9. A device according to claim 4, wherein said holding means comprise a member movable with respect to the first support member, urged by resilient means so as to project from said first member towards said second member, and adapted to snap engage a cavity formed in said base portion of the second member as a result of sliding of the first member relative to the second member along said axis of coupling.

10. A device according to claim 9, wherein said movable member is an eccentric member rotatably mounted about an axis of rotation perpendicular to said axis of coupling and radially projecting from the respective axis of rotation towards the wider transverse side of the second member, the transverse cross-section of the eccentric member having substantially the shape of a circular sector contained between two substantially radial surfaces, lower and upper respectively, between which a radially outer surface extends, the radius of which with respect to said axis of rotation increases from the lower surface to the upper surface.

11. A device according to claim 10, wherein said cavity of the base portion comprises an inclined surface facing the entry zone of the second member, whereby it has a wider portion facing the first member, such an inclined surface being intended to promote sliding of the radially outer surface of said eccentric member.

12. A device according to claim 4, wherein said holding means allow possible clearances originated between the support members in the direction of the axis of coupling to be automatically recovered.

13. Device according to claim 4, wherein means adapted to allow the holding means to be the disengaged with respect to the seats of the second support member, are associated with the holding means.

14. A device according to claim 13, wherein said disengagement means are of the mechanical type and comprise a threaded thrust member axially movable in a threaded through hole of the first support member for increasing the bending of said leaf spring in order to cause retraction of its ends, so as to cause them to disengage the seats of the second support member.

15. A device according to claim 13, wherein said disengagement means can be operated remotely, and comprise an actuator, particularly of the hydraulic or electrical type, associated with the first support member, which is able to cause retraction of the holding means so as to disengage them from the seats of the second support member.

* * * * *